United States Patent [19]

Ovaska et al.

[11] Patent Number: 4,844,204

[45] Date of Patent: Jul. 4, 1989

[54] PROCEDURE FOR MODERNIZING THE CONTROL SYSTEM OF A LIFT

[75] Inventors: Seppo Ovaska, Hyvinkää ; Ralf Ekholm, Helsinki, both of Finland

[73] Assignee: Kone Elevator GmbH, Baar, Switzerland

[21] Appl. No.: 668,015

[22] Filed: Nov. 5, 1984

[30] Foreign Application Priority Data

Mar. 14, 1984 [FI] Finland ..... 841035

[51] Int. Cl.[4] ..... B66B 1/00

[52] U.S. Cl. ..... 187/101

[58] Field of Search ..... 187/29, 101, 112, 130

[56] References Cited

U.S. PATENT DOCUMENTS 4,191,277 3/1980 Meyer et al. ..... 187/29 R 4,346,789 8/1982 Ekholm ..... 187/29 R 4,363,381 12/1982 Bittar ..... 187/29 R 4,410,959 10/1983 Tajima et al. ..... 187/29 R X

*Primary Examiner*—William M. Shoop, Jr.

*Assistant Examiner*—W. E. Duncanson, Jr.

*Attorney, Agent, or Firm*—Browdy and Neimark

[57] ABSTRACT

The present invention concerns a procedure for modernizing the control system of a lift group, in which procedure the group control system coordinating the operation of the lifts is renovated and connected to the already existing lift-specific control system. As taught by the new procedure, for each lift is connected one matching computer between the new group control and the apparatus controlling the functions of the lift, and by the aid of which the lift-specific signals are transmitted to the control of the lift and to the group control.

9 Claims, 3 Drawing Sheets

PROCEDURE FOR MODERNIZING THE CONTROL SYSTEM OF A LIFT

BACKGROUND OF THE INVENTION

The present invention concerns a procedure for modernizing the control system of a lift group, in the procedure the group control system coordinating the functions of the lifts being renovated and connected to an already existing lift-specific control system.

When old lift groups are being modernized it is desirable that the changes of the control system can be accomplished in one lift or, in big groups, in a few lifts at a time so that the lift service is disturbed as little as possible. In this way, long waiting times can be avoided which are incurred when the disconnected lifts lower the capacity of the lift group.

Since disconnection cannot be entirely avoided, the best solution is to proceed by steps in the modernizing process in the way that the first step is directed to improving the efficiency of the group control utilizing the facilities offered by new technology, applying them so that no disturbances are caused in the house during transition, while at the same time the advantage in transport capacity gained from the change is maximized.

Known in the art are procedures in which normal control systems designed for new houses are used and the control system of the lift group is modernized by steps in the way that one lift or a few lifts at a time are taken out of service. In accordance with such solutions, all changes on the control of one lift are made at one time and in the case of several lifts, totally or partly in parallel. It is thus understood that the new group control is installed and connected in parallel with the old control to control the lifts which have already been modernized.

This results in several drawbacks:

The transport capacity available in the building is remarkably lowered for the duration of the changes; for instance, in a group of four lifts the transport capacity drops to one half, since usually two lifts at a time are disconnected. One has to bear in mind that this phase during which the transport capacity is considerably reduced lasts for several months as a rule.

In addition, said procedure has the remarkable drawback that in big lift groups in which the work is carried out in more than two phases, there will be a long transition period during the changes in which the whole lift group is controlled by two different group controls. This results in several drawbacks:

First, coordination is incomplete, resulting in reduced capacity and longer waiting times in comparison with the situation in which there is the same number of lifts available and they are controlled by one group control. Secondly, in this kind of situation the landings usually have two sets of call buttons because owing to differences in technology it is not worth while to connect together temporarily the group controls representing two different generations; as a consequence, the passengers will as a rule press the button of both systems, "to make sure", whereby both group controls will dispatch a lift to the landing in question, and this results in even further reduction of capacity and longer waiting times.

Also known in the art are control systems specifically intended for modernizing jobs, and associated modernizing procedures. They are based on replacement of the old group control by a new, microcomputer- based system including a powerful microcomputer to which the input and output data required in controlling all old lifts are directly connected.

To this end, the control system contains a great number of voltage adapters, e.g. in a lift group of medium size up to a thousand units. In order to minimize the work required by the change, the old lift- specific control and adjustment means are only altered enough to enable the requisite signals to be exchanged between the old system and the new system.

This procedure has the drawback that further modernizing becomes difficult. To wit, when in the future the lift-specific controls are replaced by new technology, the connections to the group control which has been changed once already have to be changed again, because the adapter circuits for its signals were in their time matched to the structural and operational principles applied in control systems implemented with relay, transistor or discrete logic circuitry.

Apart from the fact that the voltages are higher in old systems and they are frequently a.c. voltages, the principles of operation are greatly different owing to the use of electromechanical ancillaries, such as the floor selector for instance. Maintaining the voltage and data definitions of the signals of the old designs in new products involves technical problems and extra costs and, in the long run, spare part and training problems in the service department. When solving these problems, the designer must moreover make compromises, with the result that all benefits afforded by modern technology cannot be utilized.

Another significant drawback of systems intended exclusively for modernizing is their restricted traffic technological performance and their inflexibility with reference to single needs of change arising for instance out of changed regulations. It is obvious that the deficiencies of the basic system remain in the main, since improved systems of this type do not yet perform any optimation of call distributing. The call distributing principles are complicated and slow to develop, and therefore it has usually only been possible to upgrade the principles of operation of the systems at those points where the computer could be applied in a simple manner to improve the principles of the old-fashioned system already in use, e.g. to recognize certain traffic situations and excessive waiting times and to carry out supplementary action accordingly.

OBJECT OF THE INVENTION

In order to eliminate the drawbacks mentioned, the procedure of the invention is characterized in that for each lift is connected a matching computer between the new group control and the apparatus controlling the functions of the lift and by the aid of which the lift-specific signals are transmitted to the control of the lift and to the group control.

By the procedure of the invention, the advantage is gained that the changing of the entire lift group may be phased in the way that the first phase concerns mainly the group control, whereby the greater part of the work can be carried out as preparatory work in advance. Transfer to the new control will then be swiftly accomplished, and since only one group control is in use, no reduction of capacity owing to parallel systems is incurred.

Further modernizing work is invariably called for in practice after a few years. In a lift group provided with intelligent and modifiable group control as taught by the invention, this is mainly directed on the control apparatus of the lift itself, for instance on improving the control of the old drive and improving the equipment in the shaft. As a rule, these measures are very time-consuming, but in the manner taught by the invention even such further modernizing can be carried out, throughout the duration of the work, under control by one group control.

An advantageous embodiment of the procedure of the invention is characterized in that the matching computer at least partly forms the signals required by the group control, either by supplementing the existing signals of the lift, or by generating them itself from other signals by means of logical deduction.

Such forming of additional signals is frequently necessary with a view to efficient operation of the new group control; the additional signals can be formed with ease by matching computers as taught by the invention.

Another advantageous embodiment of the procedure of the invention is characterized in that the matching computer at least in part replaces the original apparatus controlling the functions of the lift by performing also functions of lift control.

Yet another advantageous embodiment of the procedure of the invention is characterized in that the matching computers of the lift group are disposed to communicate with the group control over two separate data transfer buses.

BRIEF DESCRIPTION OF THE DRAWINGS

The invention is described in the following more in detail with the aid of an example, referring to the drawing attached, wherein.

DETAILED DESCRIPTION OF PREFERRED EMBODIMENTS

Figure 1:
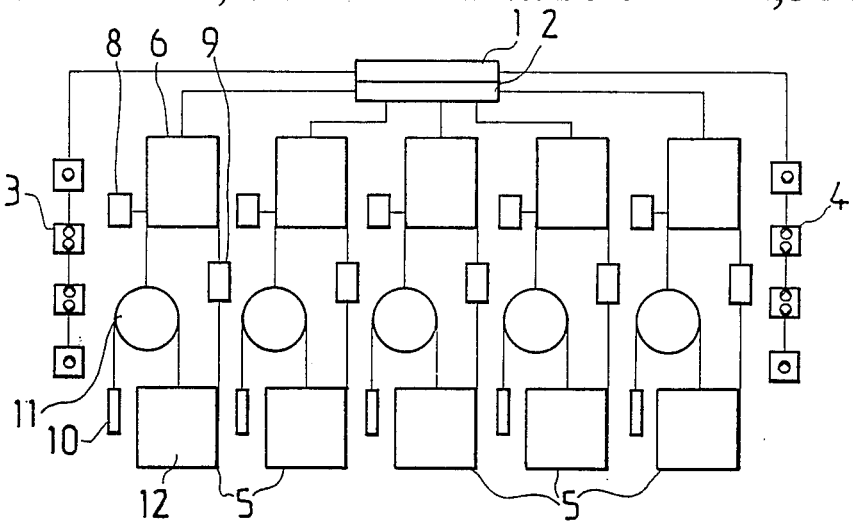
Fig. 1 PRIOR ART
FIG. 1 presents the apparatus of a lift group applying the technology of prior art, at block diagram level.

In the case represented by the block diagram of FIG. 1, the typical apparatus of a lift group employing the old technology consists of a matching unit 1 for the calls arriving from the landings, a distributing unit 2 for the calls coming from the landings, call button sets 3 and 4 on the landings, and five identical lifts 5, and of lift parts as follows: a separate lift controlling unit 6, separate control functions associated therewith, such as a generator 8 and a floor selector 9. The main components of the lift itself are the counterweight 10, the motor 11 and the lift car 12.

When the modernizing procedure of the invention is applied, work in the engine room starts by installing both the new group control and the matching computers. The positioning in the engine room is easy because the units are small, and the connection between the matching computers and the group control computers is in so-called series mode, whereby there are few connections, and even relatively long distances involve no risk of interference.

In the next phase, test runs of the group controls are made, using test programs and a terminal, whereafter one lift is taken out of use and the matching computer is connected to the old control system. This is accomplished in that simply most of the signals are connected to the terminal strips of the old control. Some of the signals have to be connected directly to relay circuits, in parallel with the old relay, in that the path of the old signal is interrupted and a contact is inserted. When this work has been completed, the lift is started under the new group control, whereafter the next lift is taken out for connecting, and so on until all the lifts are connected to the new lift control.

Figure 2:
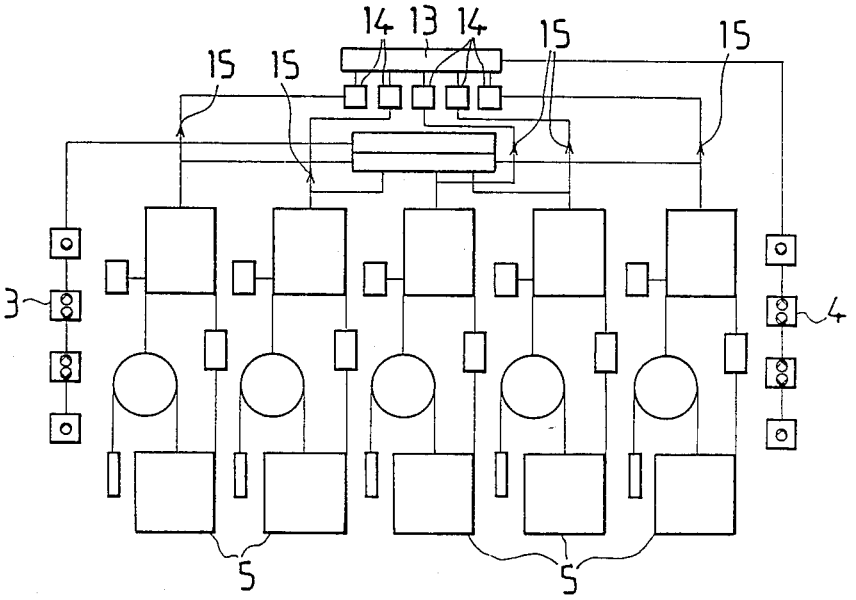
FIG. 2 presents the modernizing of the lift group of FIG. 1, in accordance with an embodiment of the invention, after the modernizing has proceeded to the phase where the new control is able to follow the operation of the old lift control.

In FIG. 2 is shown the diagram of the phase in the modernizing in which the new group control 13 and the matching computers 14 have been installed and in which the connections have been partly completed so that the matching computers are able to follow the operation of the old lift controls but exert no control on them, this being indicated by the signal direction arrows 15. As shown in FIG. 2, one of the two sets of call buttons has also been connected to the new control 13.

Figure 3:
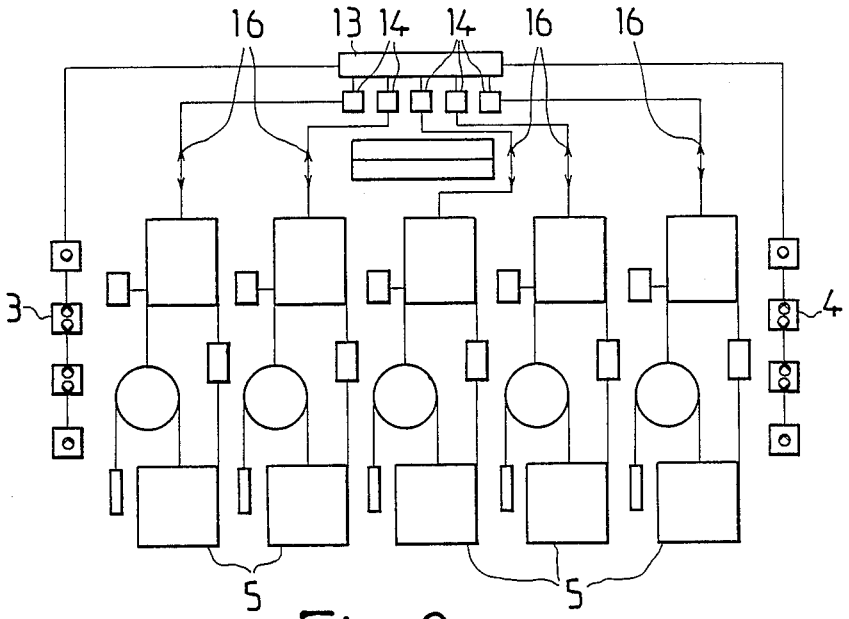
FIG. 3 presents the end situation of the modernization as in FIG. 2.

In FIG. 3, the modernizing process has proceeded to the end situation of one embodiment of the invention, in which the lifts 5 have been transferred to range under the new group control, this being indicated by two-way arrows 16 representing the passage of the signals, and in which also the other landing call button set (3) has been connected to the new group control 13. The transfer of the lifts to come under the new control is in this phase a very simple wiring job, accomplished for one lift at a time with minimal delay.

Figure 4:
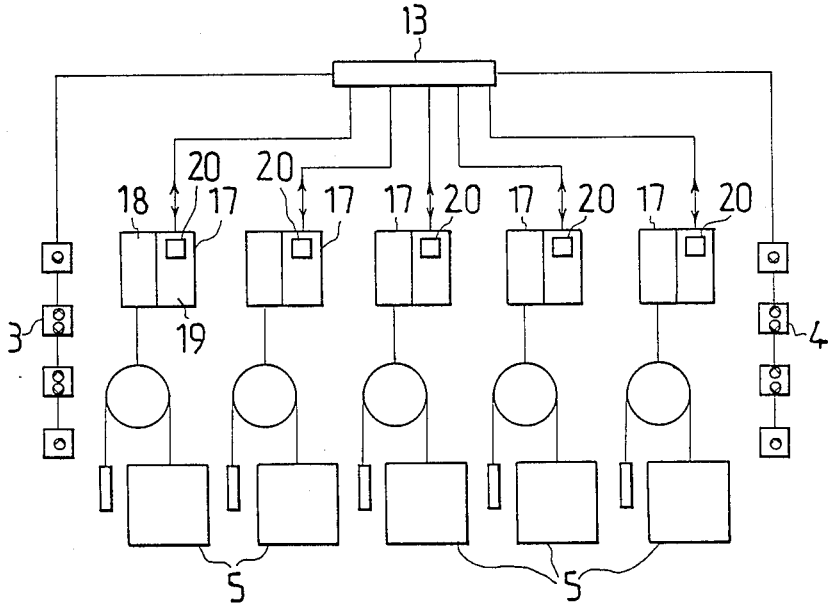
FIG. 4 presents the modernizing of the lift group of FIG 1, in accordance with another embodiment, based on the situation depicted in FIG. 3.

In FIG. 4 is shown the block diagram of the end phase in the modernizing according to another embodiment, in which the lifts 5 have been provided with new lift-specific controls 17 with two parts, a power control part 18 and a lift control part 19, the latter comprising a computer 20 and replacing the matching computer 14 which controlled the lift at the earlier phase of the modernizing process.

Figure 5:
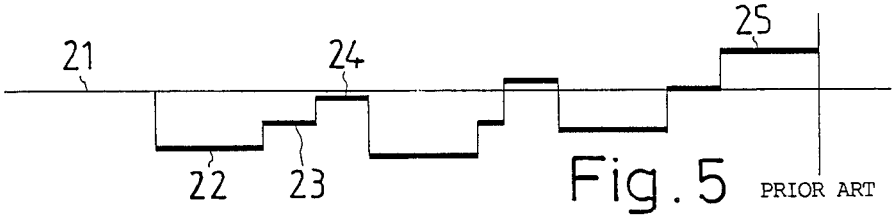
FIG. 5 presents a diagram revealing the change in transporting capacity of the lifts when the modernization proceeds as in methods known in the art.

In FIG. 5, a diagram is presented representing the changes in transporting capacity of the lifts when a conventional modernizing procedure of is being applied. Let us take, for example, a group of six lifts, which is divided into three parts. In the figure, the level 21 represents the capacity of the old lift group, the level 22 represents the situation when two lifts have been disconnected for repairs, the level 23 that after the first renovated lift has been taken into use, and the level 24 that when the second renovated lift has been recommissioned. The modernizing continues with the next pair of lifts in similar manner, until the end result of the entire process is achieved on the level 25.

Figure 6:
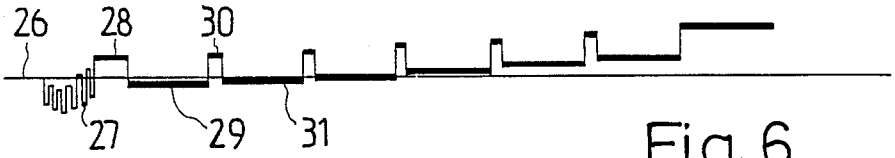
FIG. 6 shows a diagram revealing the change in transporting capacity of the lifts when the modernization proceeds as taught by the invention.

In FIG. 6, a diagram is presented representing the changes in transporting capacity of the lifts when the modernizing is done by the procedure of the invention. In the group of six lifts, at first only the group control is modernized, where the level 26 represents the capacity of the old lift group, the interval 27 represents the situation when the lifts are disconnected from the old system, one at a time, and are connected to the new system. The level 28 represents the situation between two different embodiments. If considered necessary, the modernizing may be continued after an arbitrary period of time for accomplishing a control system as in FIG. 4, where the level 29 represents the situation in which the first lift is shut down for further modernizing, the level 30 represents the completion of the first lift, and 31 the modernizing of the next lift, and so on.

In assessing the lift service upgrading effect of the modernizing of a lift control system, the quality of the old system in use is naturally a key factor. It is obvious to an expert that the levels in the diagram represent the progress of the work in principle and that even significant differences occur in practice, while the proportions shown in FIGS. 5 and 6 represent typical conditions as regards both upgrading and time.

Figure 7:
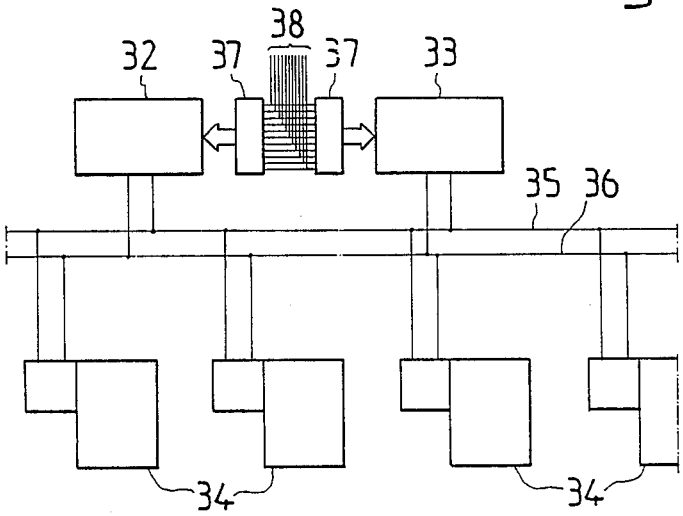
FIG. 7 shows the group control system according to an embodiment of the invention, in block diagram form.

FIG. 7 displays the structure of the group control system of an embodiment of the invention, in the form of a block diagram, comprising a controlling group control computer 32, an identical spare group control computer 33, and old lift controls 34 fitted with matchers (cf. FIG. 3) in the way that the connection from the group control computer to the matchers has been duplicateed, using two separate connection links 35 and 36. The controlling computers 32 and 33 have been connected to the outside call connections 38 over outside call matching units 37.

The group control computer depicted in FIG. 7 reads in the signals coming from the landings via the outside call matching unit 37. Based on these and on the data concerning location, car call and other status data of the lifts arriving over the other data transfer link 36, it carries out the optimation calculation for call distributing, whereafter the group control sends the booked calls over the same data transfer link 36 to each matching computer in turn.

Figure 8:
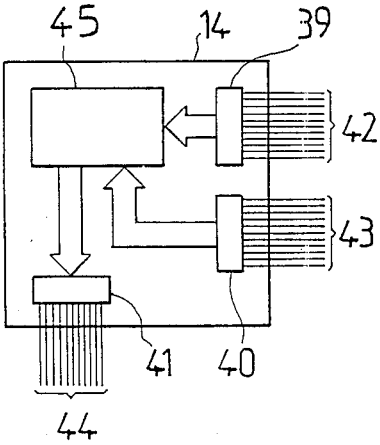
FIG. 8 presents the principle structure of the matching unit.

FIG. 8 presents the principle design of the matcher 14. The matcher comprises a computer CPU 38, a car call matching unit 39, voltage matchers 4 or matching the signals of the drive module of the lift, a relay matching unit 41, car call lines 42, incoming drive control signals 43, and outgoing drive control signals 44.

The matching computer 14 reads over the car call matching unit 39, and over the lift drive module signal matching unit 40, the requisite signals, compiles them in one table and sends this to the group control computer 32 as this computer polls the matching computers, each in turn, for data. When after the optimation calculation the group control informs the matching computers which one of the calls on the landing should be served, it supplies to the drive control a command, using the respective relay in the relay matching unit 41.

During travel, the matching computer 14 also reads over the matching unit 40, among other things, the floor selector operating in conjunction with the old drive module and which maintains the lift position information. By combining this position datum with the information received from the call buttons in the car and from the group control, the matching computer can for instance decide when the deceleration should be commenced. When this moment is at hand, it gives the decelerating command to the drive means of the lift over the relay matching unit 41. When the lift has stopped, the matching computer further delivers, over the same relay matching unit, a command to the door control, by effect of which the lift door opens by action of the original door control. That this has takan place is ascertained by polling the "door open" contact of the door control over the matching unit 40.

Based on other data, for instance those concerning the traffic situation, received from the group control, the matching computer 14 may, within the bounds of possibility, also perform actions improving the quality of operations in the instance of an individual lift control; for instance, it may upgrade the door control. By changing the door-open times consistent with the messages concerning the traffic situation from the group control computer- for instance so that in a situation with heavy upgoing traffic the door is kept open for a long time on the ground floor, on the assumption that there is a number of persons wishing to enter the car on this landing, against a brief moment only on any other floor, the assumption being that passengers only leave the car and no new passengers enter. It is obvious to a person skilled in the lift art that the matching computer may accomplish several other supplementary tasks which upgrade the capacity of performance of the lift group but which are not essential for understanding the present invention.

When operating in the manner described, the matching computer performs its actual main task which is to adapt the new and the old lift control technology to be compatible. While accomplishing this task, it collects in the manner described the requisite information from the original lift control apparatus and converts it into binary coded data which is intelligible to it. The information is transmitted in the form of lines to the group control in agreed-on sequence, accordingly as the group control requests it. Carried out in this fashion, the group control computer experiences the dispatch and reception of the data transmission as if they were taking place with a lift-specific, renovated lift control belonging to the system, which thus is the essential substance of the present invention.

Further extra tasks of the matching computer are, for instance, to produce data which may be lacking in the group control protocol, for instance by reading over the matching unit 40 the internal signals of the old control system and combining these and the basic signals already in store, to make up the lacking data.

The composition of the central unit 38 of the computer used in the matcher may, by way of example, consist of a CPU board, its auxiliary utilities board, a memory, two data transfer channel boards, and a power pack. The CPU board of the CPU of the matching computer performs the actual controlling actions and makes the decisions, using a programme stored on the memory board and the information which it receives over the data transfer bus board from the group control. The CPU board uses in certain functions the auxiliary utility board, which contains a number of auxiliary circuits, e.g. a circuit which forms desired time delays for the door control. The design and operation of this kind of computer conform to general computer technology and they are familiar to a person skilled in the art, being therefore outside the scope of the present invention.

It is obvious to a person skilled in the art that various embodiments of the invention are not exlcusively confined to the example mentioned and may vary within the scope of the claims presented below.

We claim:

1. A procedure for modernizing the control system of a bank of elevators, resulting in a new group control system for efficiently coordinating the operation of the elevators via the control systems associated with each of the elevators, comprising the steps of:

(a) installing a new group control system and an adapting computer for each elevator;

(b) connecting each of the adapting computers to communicate with the new group control system;

(c) testing said new group control system;

(d) disconnecting a selected one of said elevators from use, connecting the corresponding adapting computer to the control system of the disconnected elevator and restarting the disconnected elevator under control of the new group control system;

(e) repeating the foregoing step (d) until all elevators in the elevator bank are under control of the new group control system.

2. The procedure of claim 1, further comprising the step of successively connecting each said adapting computer to the control system of each respective elevator to replace the functions of the control system of each corresponding elevator.

3. The procedure of claim 1, further comprising the step of successively connecting each said adapting computer to the control system of each respective elevator to produce part of the signals required by the new group control system, based on signals received from the control system of each corresponding elevator.

4. The procedure of claim 1, further comprising the step of connecting the adapting computers to two separate data transfer buses to communicate with the new control system, one of said data transfer buses being an active bus and the other of said data transfer buses being a backup bus to ensure reliability.

5. A procedure for modernizing the control system of a bank of elevators, resulting in a group control system efficiently coordinating the operation of the elevators via the control systems associated with each of said elevators, comprising the steps of:

(a) installing the new group control system and an adapting computer for each elevator and connecting each of said adapting computers for communication with said group control system;

(b) testing said group control system;

(c) disconnecting each elevator in turn from use, connecting the corresponding adapting computer to the respective control system of the disconnected elevator, and reconnecting the elevator into operation so that the control of the old system is maintained but the new group control system is still aware of all the elevator operations;

(d) repeating the sequence of steps (a)–(c) until all the elevators in the elevator bank have been connected to the new group control system;

(e) disconnecting each elevator in turn from the old control system and transferring control to the new group control system until all elevators are under control of said new group control system.

6. The procedure of claim 5, further comprising the step of successively connecting each adapting computer to the control system of the corresponding elevator to replace the functions of the control system of the corresponding elevator.

7. The procedure of claim 5, further comprising the step of successively connecting each said adapting computer to the control system of the corresponding elevator to produce part of the signals required by the new group control system, based on signals received from the control system of the corresponding elevator.

8. The procedure of claim 5, further comprising the step of connecting the adapting computers to two separate data transfer buses to communicate with the new group control system, one of said data transfer buses being an active bus and the other of said data transfer buses being a backup bus to ensure reliability.

9. A procedure for modernizing the control system of a bank of elevators having an old group control system, resulting in a new group control system efficiently coordinating the operation elevator, comprising the steps of:

(a) installing the new group control system for said bank of elevators and an adapting computer for each individual elevator of said bank of elevators;

(b) connecting each of said adapting computers to communicate with said new group control system;

(c) testing said new group control system;

(d) establishing a one-way incoming connection from each individual elevator of said bank of elevators to a corresponding adapting computer, thereby allowing said new group control system to be aware of the operations of all of the elevators;

(e) disconnecting one elevator at a time from said old group control system and transferring the control to said new group control system, until all elevators are under control of the new group control system.

* * * * *